US007455573B2

(12) United States Patent
Huang et al.

(10) Patent No.: US 7,455,573 B2
(45) Date of Patent: Nov. 25, 2008

(54) FLUID JET POLISHING WITH CONSTANT PRESSURE PUMP

(75) Inventors: Zhi Huang, Kanata (CA); John H. Hunter, Almonte (CA); Graham Malcove, Kanata (CA); Ian J. Miller, Ottawa (CA); Gregg Senechal, Orleans (CA)

(73) Assignee: LightMachinery Inc., Ottawa, Ontario (CA)

( * ) Notice: Subject to any disclaimer, the term of this patent is extended or adjusted under 35 U.S.C. 154(b) by 0 days.

(21) Appl. No.: 11/850,234

(22) Filed: Sep. 5, 2007

(65) Prior Publication Data

US 2008/0057840 A1 Mar. 6, 2008

Related U.S. Application Data

(60) Provisional application No. 60/824,629, filed on Sep. 6, 2006.

(51) Int. Cl.
*B24C 5/00* (2006.01)

(52) U.S. Cl. ..... 451/91; 451/113; 451/5

(58) Field of Classification Search ..... 451/7, 451/5, 91, 104, 113, 36; 417/102, 103, 350, 417/900

See application file for complete search history.

(56) References Cited

U.S. PATENT DOCUMENTS

| | | | | |
|---|---|---|---|---|
| 4,818,191 | A | 4/1989 | Schlake | |
| 5,573,446 | A | 11/1996 | Dey et al. | |
| 5,951,369 | A | 9/1999 | Kordonski et al. | |
| 5,971,835 | A * | 10/1999 | Kordonski et al. | 451/38 |
| 6,107,203 | A | 8/2000 | Vanell | |
| 6,561,874 | B1 * | 5/2003 | Kordonski | 451/38 |
| 6,719,611 | B2 * | 4/2004 | Kordonski et al. | 451/36 |
| 6,955,585 | B2 * | 10/2005 | Mitsuishi et al. | 451/5 |
| 7,232,360 | B2 * | 6/2007 | Gadd | 451/2 |
| 2003/0039563 | A1 | 2/2003 | Arbuckle | |
| 2006/0104829 | A1 * | 5/2006 | Reed et al. | 451/350 |
| 2008/0038991 | A1 * | 2/2008 | Hunter et al. | 451/7 |

FOREIGN PATENT DOCUMENTS

| | | |
|---|---|---|
| CA | 1137812 | 12/1982 |
| CA | 1224082 | 7/1987 |
| EP | 1032486 | 12/2003 |

OTHER PUBLICATIONS

Fluid Jet Polishing', S.M. Booij, Doctoral thesis, Technische Universiteit Delft, printed in the Netherlands by PrintPartners IP Skamp B,V., Enschede, ISBN 90-9017012-X, 2003.

* cited by examiner

*Primary Examiner*—Dung Van Nguyen
(74) *Attorney, Agent, or Firm*—Teitelbaum & MacLean; Neil Teitelbaum; Doug MacLean

(57) ABSTRACT

The invention relates to fluid jet polishing machine including a pump that maintains a constant pressure in the polishing fluid during each pass of a nozzle over a component. Fluid actuated diaphragms expand and contract the volume of a pair of pump chambers, thereby eliminating the need for high-speed shafts or components in contact with the abrasive slurry.

23 Claims, 5 Drawing Sheets

Closed loop conventionalfluid jet polishing

Closed loop submerged fluid jet polishing

FLUID JET POLISHING WITH CONSTANT PRESSURE PUMP

CROSS-REFERENCE TO RELATED APPLICATIONS

The present invention claims priority from U.S. Patent Application No. 60/824,629 filed Sep. 6, 2006, which is incorporated herein by reference.

TECHNICAL FIELD

The present invention relates to a fluid jet polishing device, and in particular to a fluid jet polishing system including a constant pressure pump providing constant pressure to the working polishing fluid.

BACKGROUND OF THE INVENTION

Fluid Jet Polishing, FJP, is a method of contouring and polishing a surface by aiming a jet of slurry at a component and eroding the surface to create a desired shape. Fluid jet polishing has been studied in some detail, in particular by Silvia M. Booij see ISBN 90-9017012-X, 2003.

A conventional fluid jet polishing system 1, illustrated in FIGS. 1 and 2, comprises a part holder 2 that holds a component 3 to be eroded, a contained area 4*a* with a drain 4*b*, a volume of working fluid 5, a pump 6 to pressurize the working fluid, plumbing 7 to return the working fluid to a nozzle 8, the nozzle 8 to direct the working fluid at the component 3, a motion system 10, usually computer controlled to direct the nozzle 8. The profile of the effect of a stationary fluid jet of the working fluid on the surface of the component 3 creates a tool pattern. A computer program is then used to optimize the dwell time of the tool pattern on the surface of the component 3 in order to achieve the desired final surface figure. Typically the pressure of the slurry of working fluid remains constant and the velocity (or dwell time) of the nozzle 8 is varied to remove the desired amount of material from different areas of the component 3. Alternatively the nozzle 8 can remain fixed and the component 3 can be moved. A temperature controller may be added to maintain the working fluid at a constant temperature Another similar technology, disclosed in U.S. Pat. No. 5,951,369 issued Sep. 14, 1999 to Kordonski et al, is called Magneto Rheological Finishing, (MRF). The technology uses a liquid slurry that is directed to a wheel, where it is stiffened by magnetic fields. The stiff slurry is then carried by the wheel into contact with the component to be finished. After rubbing past the component and causing erosion the slurry is then returned to its liquid state for re-circulation by removal from the magnetic field. The advantage of MRF is that the stiffened slurry provides rapid material removal. The disadvantage is that the magnet and wheel technology makes the process significantly more complex and expensive than FJP.

Conventional FJP requires a uniform continuous stream of high pressure abrasive working fluid to erode the surface of a component. The working fluid contains small abrasive particles made from hard materials, such as Aluminum Oxide, Diamond or Zirconium Oxide. Almost all materials are effectively worn away by the eroding force of the high pressure abrasive fluid. Unfortunately, elements of the pumping systems are also quickly worn out by the eroding forces of the working fluid, making pump maintenance a significant cost in both time and materials. For example, pumping systems with high speed components or shafts, such as gear pumps, that rotate inside the working fluid slurry can wear out quickly, necessitating constant repair or replacement.

Other forms of pumps, such as diaphragm pumps or peristaltic pumps, cause a pulsation in the pressure and uneven erosion of the work piece, which is a particular concern for optical processing where nanometer level errors are significant.

An object of the present invention is to overcome the shortcomings of the prior art by providing a fluid polishing device including a pressure system providing constant pressure to the working polishing fluid without the need for mechanical parts moving within the working fluid.

SUMMARY OF THE INVENTION

Accordingly, the present invention relates to a device for polishing a component comprising:

- a reservoir of polishing liquid including abrasive particles;
- a nozzle moveable back and forth over the component defining a series of strokes; and
- a diaphragm pump.

The diaphragm pump includes a first pump chamber with a first diaphragm defining a first volume;

- a second pump chamber with a second diaphragm defining a second volume;
- a valve assembly having a first position in which fluid is directed from the reservoir to the first pump chamber, and from the second pump chamber to the output conduit, and a second position in which fluid is directed from the reservoir to the second pump chamber, and from the first pump chamber to the output conduit; and
- diaphragm actuating means for driving the first diaphragm to expand the first volume and contract the second volume when the valve assembly is in the first position, and to contract the first volume and expand the second volume when the valve assembly is in the second position;
- whereby the valve assembly changes between the first position and the second position between each stroke.

BRIEF DESCRIPTION OF THE DRAWINGS

The invention will be described in greater detail with reference to the accompanying drawings which represent preferred embodiments thereof, wherein.

DETAILED DESCRIPTION

Figure 1:
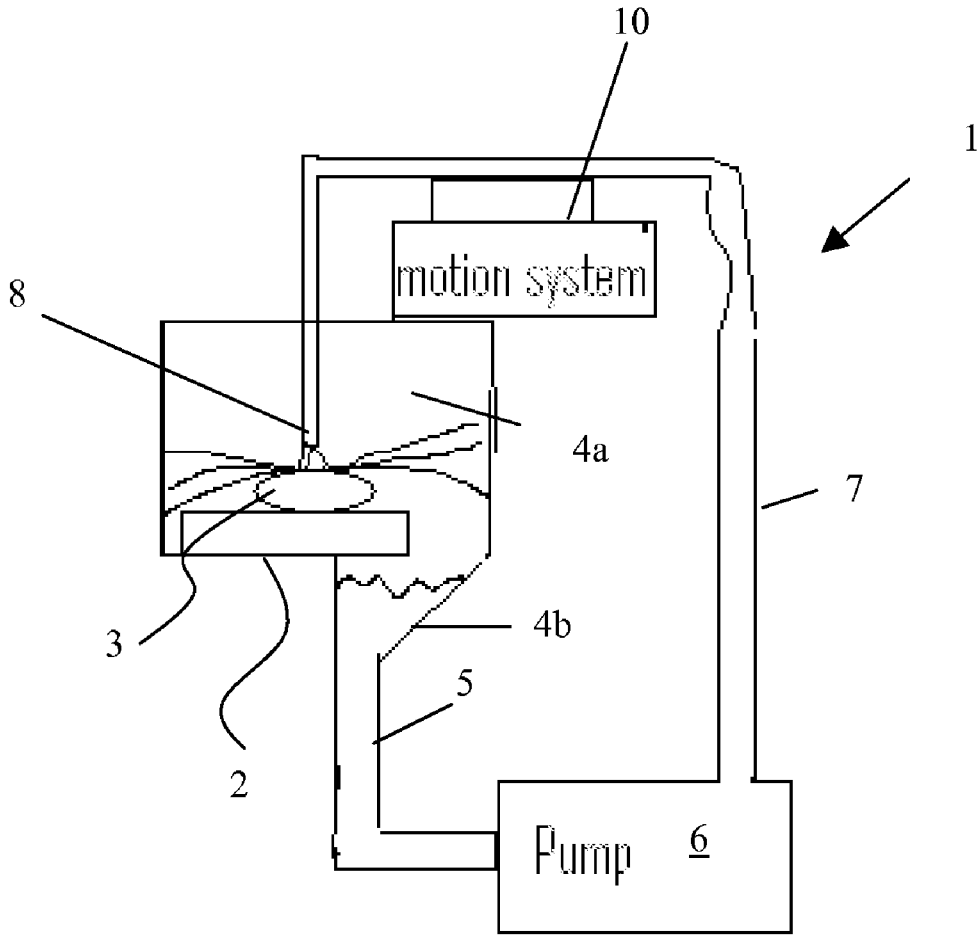
Figure 1 Prior Art
FIG. 1 is a side view of a conventional fluid jet polishing system.
Figure 2:
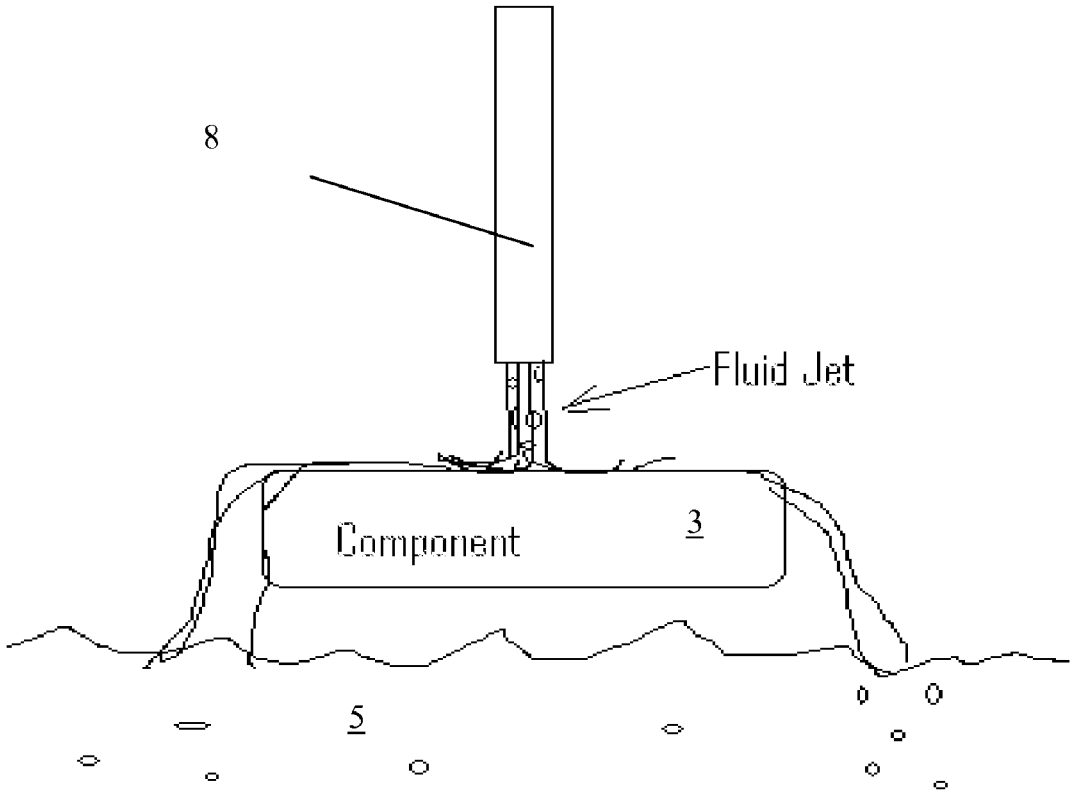
Figure 2 Prior Art
FIG. 2 is a side view of the nozzle and component of the fluid jet polishing system of FIG. 1.
Figure 3:
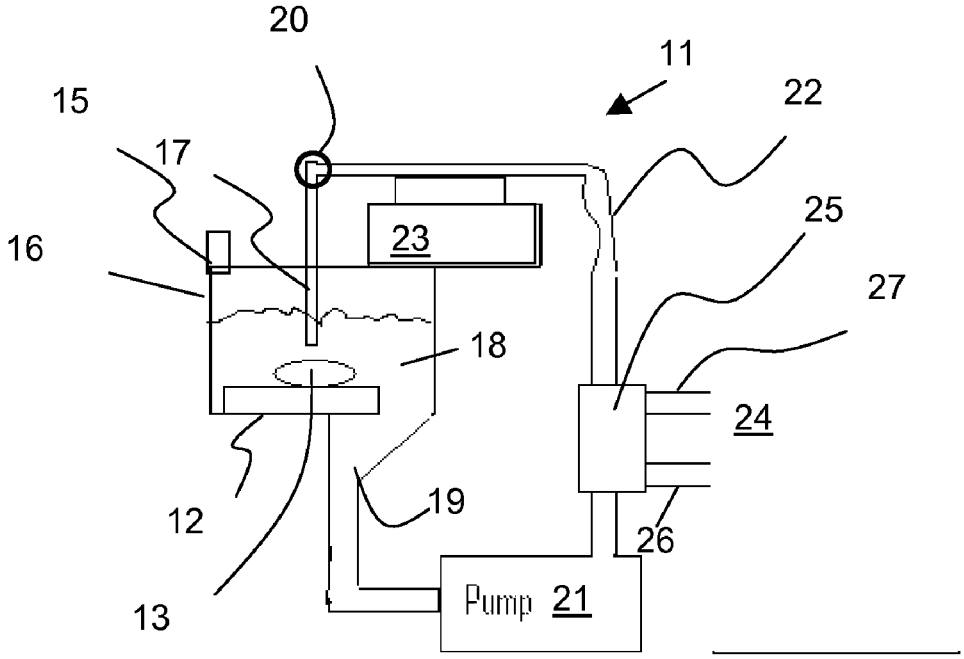
FIG. 3 is a side view of the fluid jet polishing system according to the present invention.
Figure 4:
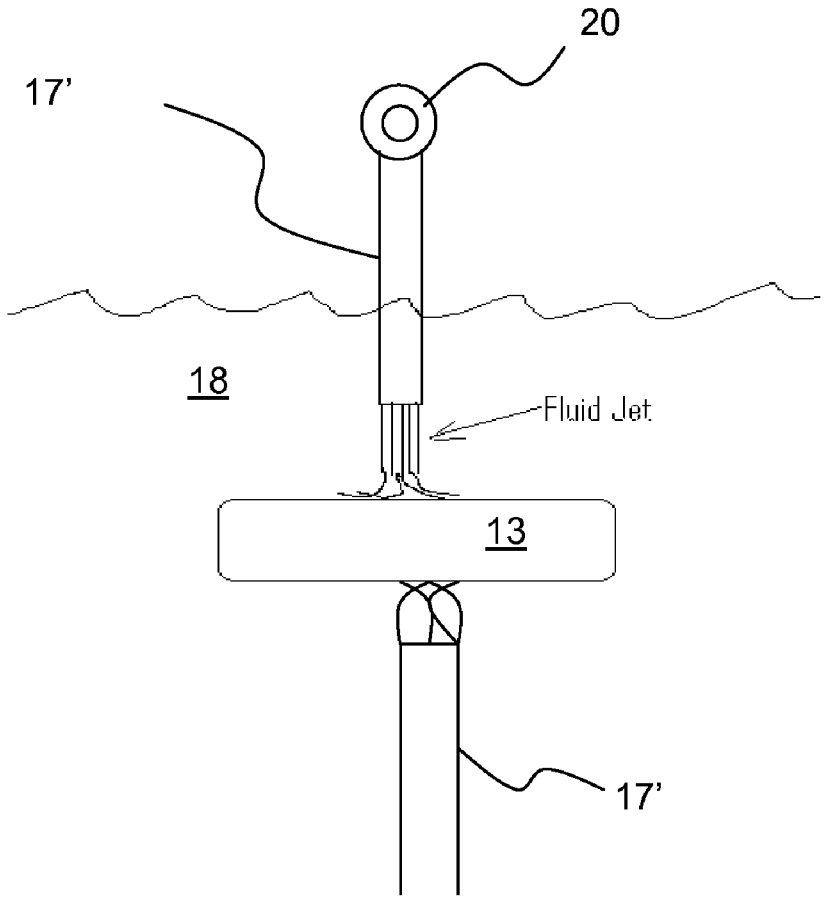
FIG. 4 is a side view of the nozzle and component of a fluid jet polishing system according to another embodiment of the present invention.
Figure 5:
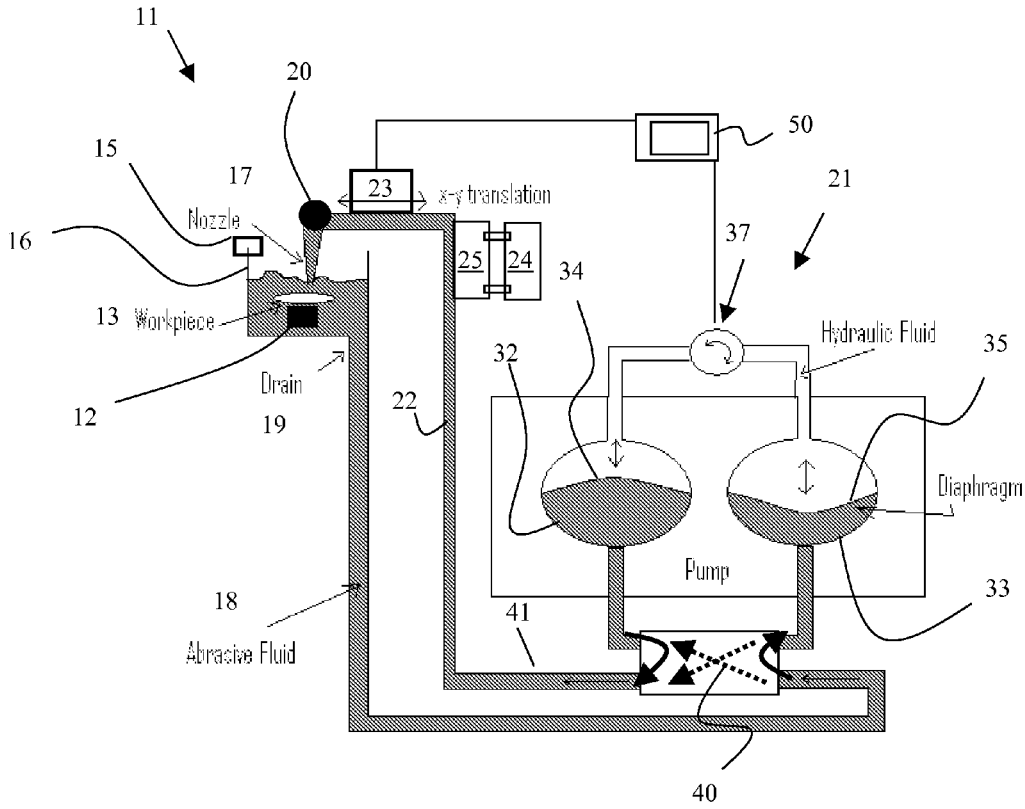
FIG. 5 is a side view of the fluid jet polishing system of FIG. 3 illustrating the pump in greater detail.

With reference to FIGS. 3, 4 and 5, a fluid jet polishing system 11, according to the present invention, includes a part holder 12, which securely holds a component 13 during the erosion process within a contained area of an erosion chamber 16. The part holder 12 can be fixed within the erosion chamber 16, rotatable relative to the erosion chamber 16 or form part of a moveable platform, as will be discussed hereinafter. Rotating the part holder 12 facilitates the production of annular or arcuate profiles in the component 13, if desired.

A nozzle 17 directs a pressurized fluid jet stream of a working fluid 18 at a surface of the component 13. The working fluid 18 contains a carrier fluid, e.g. water, glycol, oil or other suitable fluids, and small abrasive particles made from harder materials, such as Aluminum Oxide, Diamond and/or Zirconium Oxide. Varying the type and size of the abrasive particles can be done in order to optimize the surface roughness and/or removal rate. The properties of the working fluid 18 including fluid density, viscosity, pH and rheological properties, can be altered in order to optimize the surface roughness and removal rate, in particular it will be advantageous to have a dilatant fluid in order to increase the removal rate. The viscosity of dilatant fluids increases with increasing shear forces, as compared to normal fluids, in which viscosity is independent of shear forces. Accordingly, when a fluid jet stream, including a dilatant fluid, impacts on the component 13, the working fluid 18 experiences high shear forces, and therefore has an increase in viscosity, in particular at an interface between the pressurized stream of working fluid 18 and the surface of the component 13. Abrasive particles that normally have very little effect on the component 13, work much better when a dilatant additive, e.g. corn starch or poly vinyl alcohol, is added. Poly vinyl alcohol is a long chain molecule that can be cross linked to form larger molecules, all with varying degrees of dilatant property.

One of the key parameters for selecting good abrasives is density, because very dense particles come out of the working fluid 18, or move to the edge thereof, very quickly and are more aggressive. Air in the working fluid 18 rapidly increases the removal rate, because the huge decrease in buoyancy resulting from the air causes the abrasive particles to hit the surface of the component 13 very hard; however, particles with low density (high buoyancy) do not come out of the working fluid 18 easily and do not have much affect on the component 13. If suspension agents are added to keep the particles in suspension then the erosion process seems to stop all together. Accordingly, selecting abrasive particles with high density or low buoyancy in the carrier fluid, e.g. water, is important in creating a relatively rapid removal rate. For example, cerium oxide has a specific gravity of 7.8, and zirconium oxide has a specific gravity of 5.8; accordingly abrasive particles with a specific gravity greater than 5 is preferred.

Keeping the dense abrasive particles in suspension in the working fluid 18 is normally difficult and requires stirring or the use of a suspension agent to maintain. Unfortunately, as hereinbefore noted, the suspension agent, by itself, may prevent the abrasive particles from moving to the edge of the flow and doing work. However, the dilatant additive seems to solve this problem by stiffening the fluid and holding the particles quite firmly in the working fluid 18 and greatly increasing the pressure on the component 13. Accordingly, adding both a dilatant additive and a suspension agent to the working fluid 18 is a preferable combination, which eliminates the need for stirring, while providing good removal rates for a wide variety of particle densities. The aqueous suspension agent can be selected from the group consisting of: stearic acid, palmitic acid, myristic acid, lauric acid, coconut oil, palm oil, peanut oil, ethylene glycol, propylene glycol, glycerol, polyethylene glycol aliphatic polyethers, alkyl sulfates, and alkoxylated alkyphenols. The suspension agent can also be an aqueous mixture containing fat and/or fatty acid; a mixture of stearic acid and a vegetable oil; or a material sold under the trademark EVERFLO®, which comprises mostly water, about 12½ wt % stearic acid, about 12½ wt % vegetable oil, and small amounts of methyl paraben and propylene glycol.

Multiple axis (3, 4, 5 or 6) motion systems may be used to process a wide variety of component shapes. A mechanical linkage 20 may also be added to maintain the angle of the nozzle 17 over spherical or aspheric components 13, and thereby reduce the need for multi-axis motion control systems During erosion the end of the nozzle 17 and the component 13 are preferably submerged within the working fluid 18, whereby ambient air is not introduced into the closed loop of working fluid slurry. Any air bubbles that are present in the system simply bubble to an air pocket 15 at the top of the erosion chamber 16 and are not re-circulated, thereby producing surfaces with very smooth surface finishes. The air pocket 15 can be vented continuously or at time intervals. A drain pipe 19 at the bottom of the erosion chamber 16 evacuates the erosion chamber 16 and passes the working fluid 18 with eroded particles from the component 13 to a pump 21, which re-pressurizes the working fluid 18. Plumbing pipes 22 are used to return the working fluid 18 back to the nozzle 17.

A motion system 23, which is usually computer controlled, e.g. by computer 50 in FIG. 5, directs the nozzle 17 in the x-y directions or in any suitable directions, e.g. x-y-z-$\theta_z$-$\theta_y$-$\theta_x$, over the component 13 in accordance with the desired pattern and smoothness on the surface of the component 13. Alternatively, in systems in which the nozzle 17 is fixed and the part holder 12 is moveable, the motion system 23 directs the moveable platform of the part holder 12 as desired to obtain the required surface shape and roughness.

A property controller 24, including switch 25 and bypass pipes 26 and 27, may be added to control any one or more of the various properties of the working fluid 18, e.g. temperature, fluid density, viscosity, pH and Theological properties. If temperature control is required, a temperature sensor in the switch 25 determines the temperature of the working fluid 18 and reroutes all or a portion of the working fluid 18 through the property controller 24 via the bypass pipe 26, wherein the temperature of the working fluid 18 is adjusted higher or lower using suitable heating or cooling means. The thermally altered working fluid is passed back to the plumbing 22 via the return bypass pipe 27. The temperature of the working fluid 18 can be adjusted in order to optimize the removal rate of the component particles and/or the surface roughness of the component 13. In particle heating or cooling the tip of the nozzle 17 can affect the properties of the working fluid slurry thereby increasing or decreasing the removal rate, i.e. cooling the working fluid 18 will lead to a stiffer slurry and an increased removal rate. The property controller 24 can alternatively or also include means for altering the pH of the working fluid 18 by adding high or low pH materials thereto for optimizing the removal rate of component material and the surface roughness of the finished product.

Preferably, some means for vibrating or stirring the working fluid 18 is provided within the property controller 24 to maintain the abrasive particles in suspension and to optimize the removal rate and surface roughness. The fluid circulation system should be designed with as few horizontal surfaces as possible to minimize settling of the abrasive particles. Mixing by the normal flow of the working fluid 18 through the nozzle 17 and the pump 21 may be sufficient to keep the abrasive in suspension without additional stirring or vibrating means.

The profile of the effect of a stationary fluid jet on the surface of a component creates a tool pattern in the shape of an annular ring, e.g. a donut, for a vertical nozzle or in the shape of a teardrop for an angled nozzle. A computer program controlling the motion system 23 is used to optimize the dwell time of the tool pattern on the surface of the component 13 in order to achieve the desired final surface shape and smoothness. Typically, the pressure of the fluid jet of working fluid 18 remains constant and the velocity (or dwell time) of the nozzle 17 is varied to remove the desired amount of material from different areas of the component 13. Alternatively, the pressure of the working fluid 18 can be altered or the nozzle 17 can remain fixed and the component 13 can be moved, e.g. reciprocated, using the moveable platform 12, as hereinbefore discussed. The pressure of the working fluid 18 can be actively changed during the erosion process to provide different removal rates for different portions of the surface of the component 13.

Dwell time calculated for a grid of points distributed over the surface of the optical component 13 can be converted to velocity profile using $v(x,y)=d/T(x,y)$ where $v(x,y)$ is desired velocity between adjacent points and $T(x,y)$ is the calculated dwell time for the second point. Normally, the tool, e.g. nozzle 17, is moved in a raster pattern so the conversion is only applied in one direction.

Preferably, the nozzle 17 is disposed substantially vertically for launching a slurry of working fluid 18 at a constant velocity at the surface of the component 13, traveling back and forth in a simple grid pattern in the x and y directions substantially perpendicular to the surface of the component 13 with the dwell time over each position on the grid determining the amount of material removed. The coordinates of the component 13 are predetermined or determined by the computer system 50, whereby the computer system 50 can then determine the dwell time at each grid position based on the requirements, i.e. desired characteristics, e.g. dimensions, surface roughness, of the finished product. Sensors in the erosion chamber 16 and/or on the part holder 12 can be used to measuring the properties of the component 13, while the component 13 is being processed in order to create a closed loop system, thereby improving the speed and accuracy thereof.

To provide added control over the erosion process, the orifice of the nozzle 17 can be provided with an adjustable opening or a plurality of nozzles 17, each with different sized openings, can be provided. To increase the removal rate, the size of the orifice is increased or a nozzle 17 with a larger orifice is used. To increase the resolution of the removal, the size of the orifice is reduced or a nozzle 17 with a smaller opening is used. Alternatively, the shape or angle of the nozzle 17 can be changed or altered to create various tool profiles, e.g. disposing the nozzle 17 at an acute angle from vertical creates a tear drop shaped profile. Multiple nozzles 17 can also be provided to increase the speed of particle removal. The distance of the nozzle 17 from the component 13 can be adjusted between runs or actively during each run in order to optimize the resolution, removal rate of particulate material and surface roughness of the component 13. Masks can be provided to prevent the working fluid 18 from contacting certain areas of the component 13 to thereby create deep channels and concave areas. Air, or some other suitable gas for decreasing buoyancy, can be introduced into the working fluid 18 proximate the nozzle 17 or any other suitable location to increase removal rate or affect the surface roughness of the finished product.

With reference to FIG. 4, material can be removed simultaneously from different sides of the component 13, by using one or more nozzles 17' directed at opposite or different sides of the component 13 at the same time. Independent re-circulating systems can be used for each of the nozzles 17' to enable the characteristics, e.g. temperature, pH etc, of the working fluids 18 to be independently adjusted. Alternatively, a single re-circulating system can be used for all of the nozzles 17'.

With reference to FIG. 5, the pump 21 of the present invention maintains a constant pressure during a single stroke of the fluid jet nozzle 17 of a fluid jet polishing machine 11, and reverses direction after completion of a stroke. The pump 21 includes first and second pumping chambers 32 and 33, respectively, each with a diaphragm 34 and 35, respectively, for expanding and/or contracting the volume of the respective pumping chamber 32 and 33. The diaphragms 34 and 35 may be driven electrically, pneumatically or hydraulically (as in Fig 5). No high-speed shafts or components are in contact with the abrasive slurry of working fluid 18. The direction of the pump 21 is coordinated with the fluid jet polishing to ensure that the pressure at the nozzle 17 is constant during a single translation of the nozzle 17 over the work piece 13.

In the detailed embodiment shown in FIG. 5, the pump 21 includes a hydraulic (or pneumatic) actuator pump 37, which drives a hydraulic (or pneumatic) working fluid 39 from the upper part of the first pumping chamber 32, actuating the first diaphragm 34 to expand the volume of the lower part of the first pumping chamber 32. The hydraulic working fluid 39 is forced into the upper part of the second pumping chamber 33 forcing the second diaphragm 35 to contract the volume of the lower part of the second pumping chamber 33 pressurizing and forcing the abrasive fluid 18 through an output conduit 41 to the nozzle 17. When the hydraulic actuator pump 37 is actuated in the aforementioned direction, a valve assembly 40 is set in a first position (dotted lines) in which the abrasive fluid 18 flows from the drain 19 to the bottom of the first pumping chamber 32, and abrasive fluid 18 flows from the lower part of the second pumping chamber 33 through the output conduit 41 to the nozzle 17. On the next stroke the hydraulic actuator pump 37 pumps the hydraulic working fluid 39 in the reverse direction, i.e. from the top of the second pumping chamber 33 to the top of the first pumping chamber 32, and the valve assembly 40 ensures that the abrasive fluid 18 flows from the drain 19 to the bottom of the second pumping chamber 33, and from the bottom of the first pumping chamber 32 to the nozzle 17 via the output conduit 41 (see solid curved arrows). The second diaphragm 35 rises to increase the volume of the lower part of the second pumping chamber 33, creating a suction force on the abrasive fluid 18, while the first diaphragm 34 is lowered to decrease the volume of the lower part of the first pumping chamber 32, thereby pressurizing the abrasive fluid 18.

A typical diaphragm pump would operate well above 1 Hz, say 5, 10, 20, 60 Hz+, the pump 21 is preferably slower than 1 Hz, typically a few seconds to several minutes. In the jet polishing process according to the present invention, the slower the nozzle 17 is moved, the more material gets removed, i.e. the faster the nozzle 17 moves, the less material gets removed. Accordingly, on a component 13 in which the shape is to be significantly changed, it is necessary to move fast while making a pass on some rows and slower while making a pass on other rows. Therefore, it is important to have a wide dynamic range in pump speed, e.g. 5 seconds to 5 minutes. However, if there is not enough hydraulic working fluid in the first and second pumping chambers 32 and 33 or not enough abrasive fluid 18 in the system for a 5 minute pass, a double pass for 2.5 minutes can be done. The key is that the switching of the pump 21 is under complete control of computer 50, i.e. the same computer that controls the motion system 23 of the nozzle 17, whereby the pump 21 alternates between the first and second pumping chambers 32 and 33 at the same time as the nozzle 17 ends one pass on the part 13 and starts another. Typically, the pump 21 is operated to alternate between pumping chambers at an interval of between 5 seconds and 1 minute.

We claim:

1. A device for polishing a component comprising:

a reservoir of a polishing liquid including abrasive particles;

a nozzle with an opening moveable back and forth over the component defining a series of strokes;

a diaphragm pump including:

a first pump chamber with a first diaphragm defining a first volume;

a second pump chamber with a second diaphragm defining a second volume;

a valve assembly having a first position in which polishing fluid is directed from the reservoir to the first pump chamber, and from the second pump chamber to the nozzle, and a second position in which polishing fluid is directed from the reservoir to the second pump chamber, and from the first pump chamber to the nozzle; and diaphragm actuator for driving the first and second diaphragms to expand the first volume and contract the second volume when the valve assembly is in the first position, and to contract the first volume and expand the second volume when the valve assembly is in the second position; and a controller for controlling the valve assembly and the nozzle, whereby the valve assembly changes between the first position and the second position between each stroke of the nozzle;

wherein the polishing fluid includes a dilatant additive for increasing the viscosity of the polishing fluid at an interface between the pressurized stream of the polishing fluid and the surface of the component.

2. The device according to claim 1, wherein the diaphragm actuator comprises a working fluid pump for pumping a working fluid between the first and second pumping chambers, thereby alternately expanding and contracting the first and second pump chambers.

3. The device according to claim 1, further comprising:

a chamber for enclosing a component during polishing; and a holder for holding the component in the chamber during polishing;

wherein the holder and the opening of the nozzle are submerged in polishing fluid, while the stream of polishing fluid is directed at the component, whereby ambient air is not introduced into the polishing fluid.

4. The device according to claim 3, further comprising a recirculation system for recirculating the polishing fluid from the chamber back to the nozzle; wherein the chamber includes the reservoir for the polishing fluid.

5. The device according to claim 4, further comprising a temperature controller for adjusting the temperature of the polishing fluid during recirculation for controlling the removal rate of particulate matter from the component.

6. The device according to claim 5, wherein the temperature controller comprises a temperature sensor for determining the temperature of the polishing fluid; and a heater or cooler for adjusting the temperature of the polishing fluid.

7. The device according to claim 4, further comprising a pH controller for monitoring and adjusting the pH of the polishing fluid during re-circulation for controlling the removal rate of particulate matter from the component.

8. The device according to claim 1, wherein the controller reciprocates the nozzle back and forth over the component, whereby the nozzle dwells over different areas of the component based on predetermined desired characteristics.

9. The device according to claim 8, further comprising sensors connected to the controller for determining characteristics of the component during particulate matter removal for comparing current characteristics to the predetermined desired characteristics.

10. The device according to claim 1, wherein the nozzle is disposed perpendicular to the component for providing an annular profile of particulate matter removal.

11. The device according to claim 1, wherein the nozzle is disposed at an acute angle to a line vertical to the component providing a teardrop shaped profile of particulate matter removal.

12. The device according to claim 1, further comprising an air introducer proximate the nozzle for adding air into the polishing fluid for increasing the removal rate and surface roughness of the component.

13. The device according to claim 1, further comprising a stirrer for affecting the properties of the polishing fluid to maintain the abrasive particles in the polishing fluid suspension, thereby optimizing the removal rate and surface roughness.

14. The device according to claim 1, further comprising a pressure changer for altering the removal rate and surface roughness of the component.

15. The device according to claim 1, wherein the opening of the nozzle is adjustable for adjusting the removal rate and resolution of removal.

16. The device according to claim 1, wherein the height of the nozzle above the component is adjustable, thereby adjusting the removal rate and surface roughness of the component.

17. The device according to claim 1, further comprising an additional nozzle for directing a pressurized stream of polishing fluid at another surface of the component.

18. The device according to claim 1, wherein the abrasive particles have a specific gravity greater than 5.

19. The device according to claim 1, wherein the polishing fluid further comprises a suspension agent for maintaining the abrasive particles suspended in the polishing fluid.

20. A device for polishing a component comprising:

a reservoir of a polishing liquid including abrasive particles;

a nozzle with an opening moveable back and forth over the component defining a series of strokes;

a diaphragm pump including:

a first pump chamber with a first diaphragm defining a first volume;

a second pump chamber with a second diaphragm defining a second volume;

a valve assembly having a first position in which polishing fluid is directed from the reservoir to the first pump chamber, and from the second pump chamber to the nozzle, and a second position in which polishing fluid is directed from the reservoir to the second pump chamber, and from the first pump chamber to the nozzle; and diaphragm actuator for driving the first and second diaphragms to expand the first volume and contract the second volume when the valve assembly is in the first position, and to contract the first volume and expand the second volume when the valve assembly is in the second position; and a controller for controlling the valve assembly and the nozzle, whereby the valve assembly changes between the first position and the second position between each stroke of the nozzle;

wherein the diaphragm actuator comprises a working fluid pump for pumping a working fluid between the first and second pumping chambers, thereby alternately expanding and contracting the first and second pump chambers;

wherein the working fluid pump pumps the working fluid between the first and second pumping chambers at an interval of between 5 seconds and 1 minute.

21. A device for polishing a component comprising:

a reservoir of a polishing liquid including abrasive particles;

a nozzle with an opening moveable back and forth over the component defining a series of strokes;

a diaphragm pump including:

a first pump chamber with a first diaphragm defining a first volume;

a second pump chamber with a second diaphragm defining a second volume;

a valve assembly having a first position in which polishing fluid is directed from the reservoir to the first pump chamber, and from the second pump chamber to the nozzle, and a second position in which polishing fluid is directed from the reservoir to the second pump chamber, and from the first pump chamber to the nozzle; and diaphragm actuator for driving the first and second diaphragms to expand the first volume and contract the second volume when the valve assembly is in the first position, and to contract the first volume and expand the second volume when the valve assembly is in the second position;

a controller for controlling the valve assembly and the nozzle, whereby the valve assembly changes between the first position and the second position between each stroke of the nozzle;

a chamber for enclosing a component during polishing; and a holder for holding the component in the chamber during polishing;

wherein the holder and the opening of the nozzle are submerged in polishing fluid, while the stream of polishing fluid is directed at the component, whereby ambient air is not introduced into the polishing fluid;

further comprising an air pocket in the chamber, whereby any bubbles that are present in the system bubble to the air pocket and are not re-circulated.

22. The device according to claim 21, wherein the polishing fluid includes a dilatant additive for increasing the viscosity of the polishing fluid at an interface between the pressurized stream of the polishing fluid and the surface of the component.

23. The device according to claim 22, wherein the polishing fluid further comprises a suspension agent for maintaining the abrasive particles suspended in the polishing fluid.

* * * * *